United States Patent [19]

Baughcom

[11] 4,078,338

[45] Mar. 14, 1978

[54] GRAVER SHARPENING APPARATUS

[76] Inventor: Elisha J. Baughcom, Rte. 1, Box 15A, Newington, Ga. 30446

[21] Appl. No.: 718,366

[22] Filed: Aug. 27, 1976

[51] Int. Cl.[2] ..... B24B 19/00

[52] U.S. Cl. ..... 51/221 R; 51/285

[58] Field of Search ..... 51/216 R, 217 R, 217 A, 51/218 A, 221 R, 285

[56] References Cited

U.S. PATENT DOCUMENTS

| | | | |
|---|---|---|---|
| 975,329 | 11/1910 | Collins | 51/221 R |
| 1,192,416 | 7/1916 | Graves | 51/221 R |
| 2,604,738 | 7/1952 | Ramey | 51/221 R |

FOREIGN PATENT DOCUMENTS

| | | | |
|---|---|---|---|
| 28,175 of | 1913 | United Kingdom | 51/221 |

*Primary Examiner*—Harold D. Whitehead

[57] ABSTRACT

A device for holding a graver in proper relation to a grinding stone for sharpening is composed of seven main parts, namely, a frame, a graver face grinding base block, a graver heel grinding base block, a right-hand arcuate sector, a left-hand arcuate sector, both pivotally mounted on the graver heel grinding base block, a bearing hub, including graver clamping means, mounted near the mid-region of the frame, and a grinding stone assembly.

5 Claims, 11 Drawing Figures

GRAVER SHARPENING APPARATUS

BACKGROUND OF THIS INVENTION

The art is replete with elaborate automatic and semi-automatic machines for sharpening hand operated tools. Such machines are not at all suitable for the engraver who has his own small shop, or who serves jewelry stores, or similar businesses.

The skilled craftsman demands top performance of his tools and he usually has the expertise to sharpen his gravers by hand with the aid of no more than a suitable group of stones having different grades of grinding surfaces. This method of maintaining his gravers is very wasteful of the craftsman's skills, is time consuming, and still leaves room for human error.

The engraver needs a simple, small and foolproof sharpening machine that he can carry in his attache' case together with a honing assembly and the group of gravers he needs.

There is also same old art on small, and relatively simple, holders for gravers while being ground, as, for example Brower U.S. Pat. No. 223,315; Francis U.S. Pat. No. 449,673; and Dreyer U.S. Pat. No. 1,034,595.

The modern holders for gravers, while being ground, on the market, are in general built on the plan of this very old art just cited. From fifteen to 25 movements are needed to get a square graver in positions to grind the face and the two heels.

To get a flat graver into its two positions for grinding its face and heel require almost as many movements.

A broad object of this invention is to provide a small and simple graver holder that requires only the proper insertion and securing of the graver in the holder and there after requires no adjustments to properly grind and polish the faces of the graver to insure that good sharp cutting edges are obtained.

In a modification of this invention it is an object to provide, in a small graver holder, simple means on the holder for adjusting the relation of the axis of the graver shank to the honing assembly and the plane of the work table.

These two objects stated are merely illustrative. Other important, as well as more detailed, objects will become more apparent from the disclosure of the novel features herein described in detail with reference to the drawings, in which.

Figure 5:
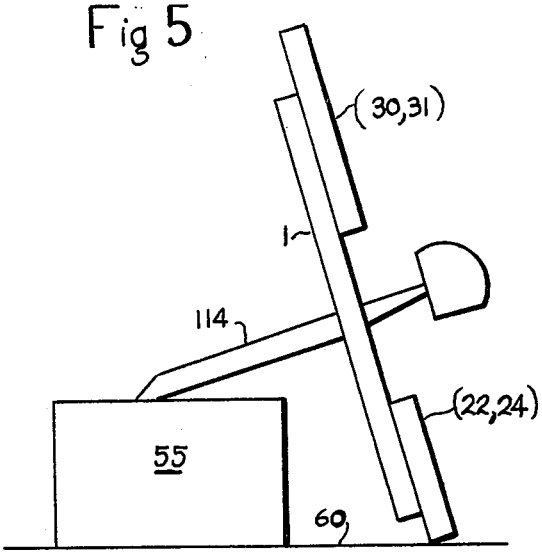
Figure 6:
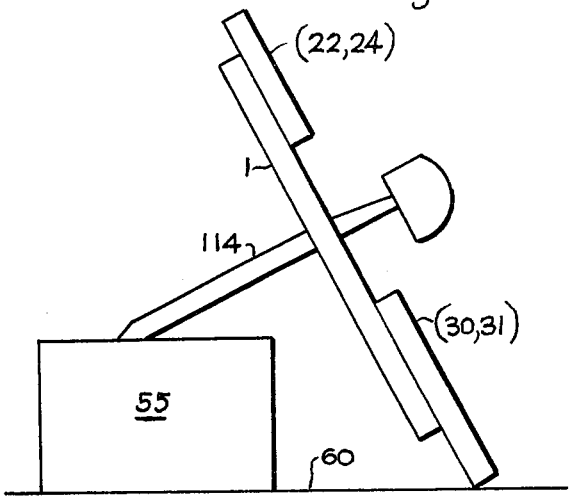
Figure 7:
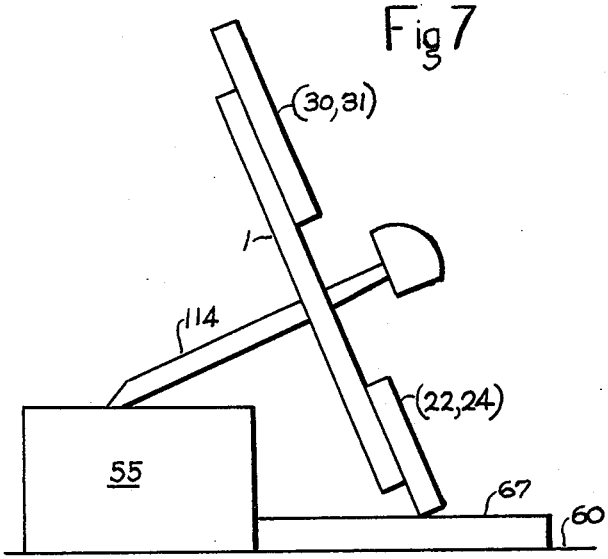
Figure 8:
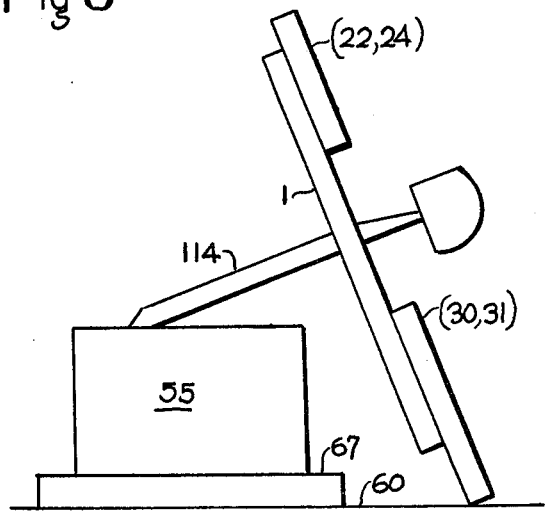
Figure 9:
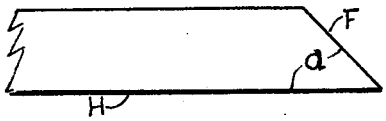
Figure 10:
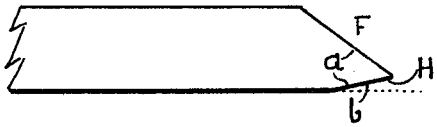
Figure 11:
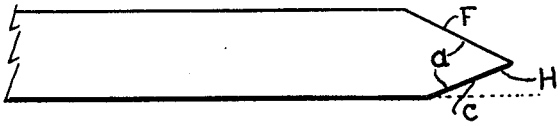

FIGS. 5, 6, 7, and 8 are all schematic showings, showing respectively, four distinct grinding operations for a flat graver having a single adjusted position in the apparatus;

FIG. 9 is a somewhat enlarged showing of the cutting end of a flat graver, as usually available from the manufacturer to the engraver;

FIG. 10 is a showing, of the same graver shown in FIG. 9, after the engraver has performed the two grinding operations depicted in FIGS. 5 and 6; and FIG. 11 is a showing of the same graver shown in FIG. 9, after the engraver has performed the two grinding operations depicted in FIGS. 7 and 8.

DETAILED DESCRIPTION OF THE INVENTION

Figure 3:
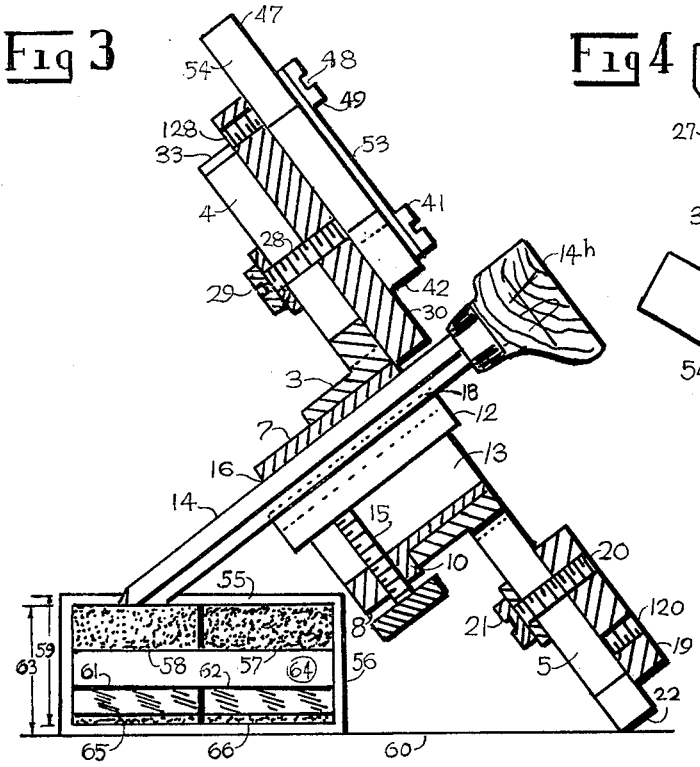
FIG. 3 is a vertical sectional view of the showing in FIG. 1, with the stone assembly also shown in section but the square graver not shown in section.

All the parts of the graver holder are mounted on an elongated frame 1 rectangular in shape, and the frame 1 has, as a rigid part thereof, a bearing hub 3 projecting to the left, as seen in FIG. 3, from the frame. The axis of the bearing hub intersects the mid-line of the frame at right angles and is dispose somewhat nearer the bottom end of the frame.

The frame 1 has a slot 4 at its top and a somewhat shorter slot 5 at its bottom. Both slots are aligned with the midline of the frame. A graver holder shaft 7 fits snugly into the hub 3 and may be held in any fixed relation to the hub 3 by set screw 9.

The hub 3 has a boss 11, as a rigid part of the hub, projecting beyond the left end of the hub. The boss 11 has a left face falling in a plane radially of the hub axis. The particular radial plane selected should preferably be the one that also includes the midline of the frame 1.

The graver holder shaft has a longitudinal opening 13 having a shape, viewed on a transverse section, roughly the shape of a baseball diamond, with the planes converging at "home base" forming a sharp right angle groove the length of the shaft 7 to form a seat 16 for the shank of a square graver 14. By means of set screw 9 the shaft 7 may be clamped in all the angular positions needed for shaft 7.

The outer or forward end of shaft 7 has a lug 8 for receiving the graver clamping set screw 15. At the lower end of lug 8 under set screw 15 a boss 10 projects radially of the lug 8 into the circumferential region of boss 11. The boss 10 has a right face falling in a plane disposed radially of the hub axis, thus, when shaft 7 is turned counter-clockwise until the right radial face of boss 10 engages the left radial face of boss 11, then the corner of seat 16 will fall in the radial plane including the midline of frame 1.

Figure 4:
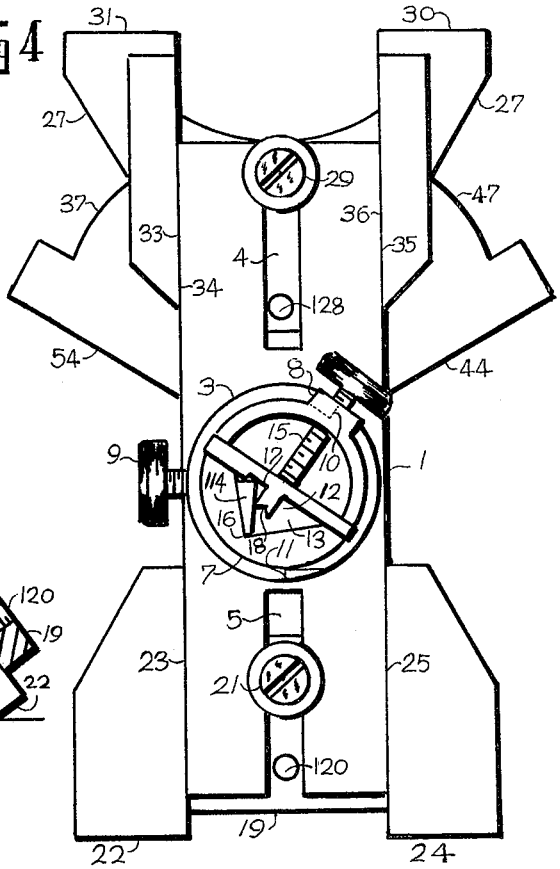
FIG. 4 is a front view, similar to the showing in FIG. 1, but with the graver heel grinding base block up and a flat graver mounted in position.

A floating binding bar 12 is used between the graver shank and the clampscrew 15. This binding bar has a right angle V-groove 18 along its full length to fit the corner of the square graver. The floating bar 12 also has a groove 17 longitudinally thereof off-set from the V-groove to bind flat gravers against seat 16, as it is shown in FIG. 4. The floating bar 12 has a T-shaped front end longer than the width of the opening in shaft 7 to keep the bar 12 from falling through the longitudinal opening in shaft 7.

A face grinding base block 19 has a locking screw 20 threaded into its front face and positioned so that the screw stem projects through slot 5 and the head 21, which is bigger in diameter than the width of slot 5, is in front of the front face of frame 1.

A leg 22 having a right edge 23 is rigidly glued to the block 19 with its right edge 23 disposed against the left edge of frame 1, and a leg 24 is rigidly glued to the block 19 with its left edge 25 disposed against the right edge of frame 1.

The face grinding base block 19 may thus be adjusted to any position on the bottom end of frame 1, within the length of slot 5, and locked into any of its adjusted positions by screw 20.

Corresponding points, as the outer corners, mid-points, or inner corners, at the bottom ends, or work-table engaging regions, or edges, of legs 22 and 24, will thus always be at equal radial distances from the axis of reference of hub 3.

The heel grinding base block 27, and the elements closely associated with it, are best shown in FIG. 4. The heel grinding base block 27 has a locking screw 28 threaded into its front face and positioned so that the screw stem projects through slot 4 and the head 29, which is bigger in diameter than the width of slot 4, is in front of the front face of frame 1.

The heel grinding base block 27, has, as an integral part thereof, legs 30 and 31. A left-hand side guide rail 33 is rigidly glued to the front face of the top end of frame, and a right-hand side guide rail 35 is rigidly glued to the front face of the top end of frame. Rail 33 has a right-edge 34 disposed against the left edge of the top end of frame 1 and rail 35 has a left edge 36 disposed against the right edge of the top end of frame 1.

The heel grinding base block 27 may thus be adjusted to any position on the top end of frame 1, within the limits of the slot 4, and locked into any of its adjusted positions by screw 28.

Since the portion of the frame 1 above the axis of hub 3 is longer than the portion of the frame 1 below the axis of hub 3, and the slot 4 is longer than the slot 5, it is apparent that the heel grinding base block 27 can be moved farther away from the axis of hub 3 than the face grinding base block 19. This also means that corresponding points at the top ends, or work-table engaging regions, or edges, of legs 30 and 31, will always be at equal radial distances from the axis of hub 3, but it also means these radial distances are greater and thus not equal to the radial distances discussed in connection with legs 22 and 24.

The ranges of positional adjustments of blocks 19 and 27 are such that the two radial distances here discussed may be made equal, but such adjustments are rarely needed.

The square graver is the prime graver for most engravers because of the many types of cuts it can be made to perform, but it is also by far the most difficult to sharpen.

Figure 1:
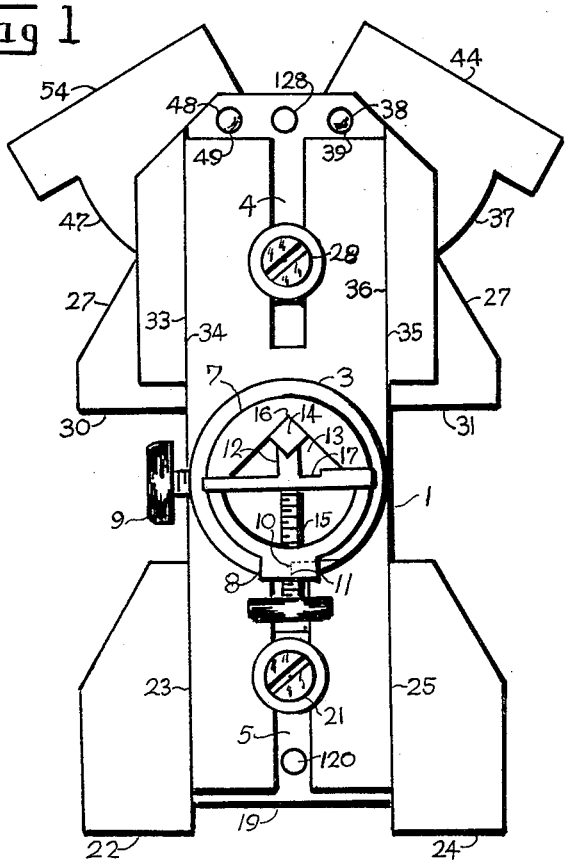
FIG. 1 is a front view of the holder with the graver face grinding base block shown down, the graver heel grinding base block shown up, with a square graver shown in position, and the grinding assembly not shown.
Figure 2:
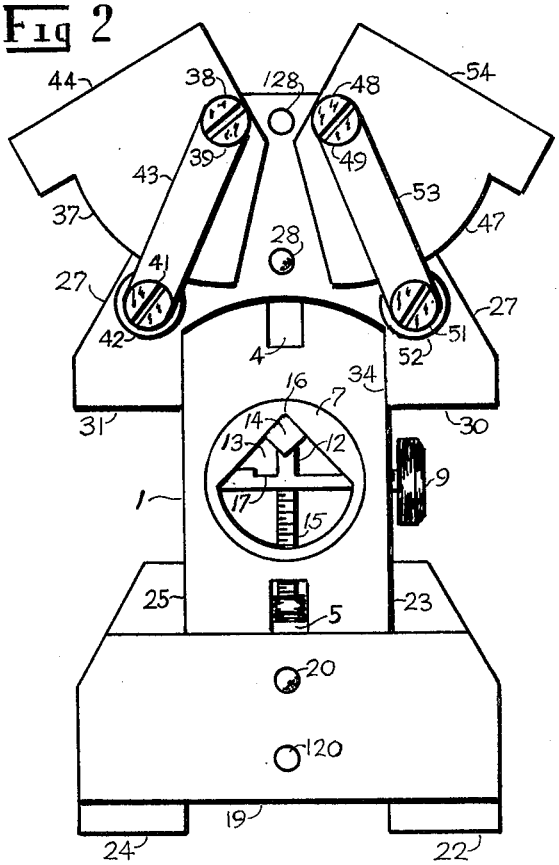
FIG. 2 is a rear view of the showing in FIG. 1.

The angles of the two heels may be, in most cases, the same, but to provide for different heel angles two arcuate pivotally mounted sectors are used. To better understand the structure and function of the heel-grinding elements reference for orientation should be made to FIG. 2.

Arcuate sector 37 is pivoted at 38 on the heel grinding base block 27 on clamping screw 39. A second clamping screw 41 is tapped into block 27 and has a spacer sleeve 42 about its stem. The length of the spacer sleeve 42 is slightly shorter than the thickness of the arcuate sector 37. By the use of a washer bar 43 and the tightening of screws 39 and 41 the arcuate sector 37 may be securely held in any angular position to which it may have been moved for use. Arcuate sector 37 has a straight-edged work table engaging bar 44.

Arcuate sector 47 is pivoted at 48 on the stem of clamping screw 49 tapped into block 27. A second clamping screw 51 is tapped into block 27 and has a spacer sleeve 52 about its stem. The length of the spacer sleeve 52 is slightly shorter than the thickness of the arcuate sector 47. By the use of a washer bar 53 and the tightening of screws 49 and 51 the arcuate sector 47 may be securely held in any angular position to which it is moved for use. Arcuate sector 47 has a straight-edged work table engaging bar 54.

Since arcuate sector 37 is pivoted at 38, the radial distance from the axis of hub 3 to the straight-edged work-table engaging bar 44 may be adjusted, at will, within the range provided.

Similarly, the arcuate sector 47, being pivoted at 48, the radial distance from the axis of hub 3 to the straight-edged work-table engaging bar 54 may be adjusted, at will, within the range of adjustment provided.

An adjustment that makes the radial distances from the bars 44 and 54 equal is for, some jobs, not a preferred adjustment.

To summarize some of the foregoing description: This apparatus provides four work-table engaging regions that may have equal or unequal radial distances from the axis of hub 3. The choice is up to the engraver, as needed, for any particular engraving job he wishes to do.

To provide for firm gripping of the graver in use the handle **14*h*** is usually as shown.

Of course, no graver sharpening device is complete without the honing stones. FIG. 3 shows the honing assembly 55 including two holders 56, with the front one not shown, for stones 57 and 58, held in position by plaster or other means as 64.

The stones are so mounted that the coarse grain stone 57 and the finer grain stone 58 have their top surfaces in the same level plane a distance represented by 63 from the flat plate glass work table 60.

Two flat glass plates 61 and 62 with the abrasive papers in place are mounted in the holder 56 so that when the stone assembly is inverted the then top planes of the abrasive paper fall in the same level plane and are a selected distance 59 from the plate glass work table 60. The distances 59 and 63 are the same. This means when the honing assembly is inverted the grinding surfaces will engage the graver in the same level plane.

To hold all the parts rigidly in the assembly 55 plaster of Paris 64 or some similar material may be used.

To get a fine polish, a mirror polish if needed, fine polishing sheets 65 and 66 may be secured on the glass plates 61 and 62, respectively. Polishing sheet 65 may be 2/0 paper and sheet 66 may be 4/0 paper.

The work table may be of any smooth surface having no affinity for the material used in the tool holder. Polyvinylchloride used for the holder has no affinity for glass and a glass plate as 60 is very satisfactory.

When a flat graver is to be sharpened legs 30 and 31 have to be used. To accomplish this the heel grinding base block 27, with all the parts carried by it is removed from the frame and then turned through 180° on a horizontal axis and then turned 180° on a vertical axis and then placed back on the frame 1, resulting in a showing of parts as seen in FIG. 4.

When the adjustments of blocks 19 and 27 have to be greater than provided for by slots 4 and 5 and screws 28 and 20 then additional tapped holes 128 and 120 may be used. By the use of these additional holes a large range of angles for the heels is made available.

When a graver is to be sharpened it is clamped on the holder at the desired position along its shank. Then the blocks 19 and 27 are adjusted and clamped at their respective correct positions on frame 1.

If the graver to be sharpened is a flat graver 114, and the work table engaging legs 22, 24, 30 and 31 are in the position shown in FIG. 4, no further adjustments are necessary.

However, if a square graver 14 is to be sharpened then the arcuate sectors 37 and 47 also require adjustment, namely they need to be adjusted to their respective correct angular positions on block 27 and there clamped on block 27.

Ordinarily, any skilled engraver, from his experience and a few trials, has established the face angle and the heel angles comfortable to him and made these few simple adjustments needed. Thereafter he can sharpen graver after graver, with no further adjustments.

To better understand the novel features of this invention reference should be had to FIGS. 5 to 8, inclusive, illustrating the various grinding functions on a flat graver, and to FIGS. 9 to 11, inclusive, showing the changes obtained on the cutting end of a flat graver.

The grinding functions for a square graver are substantially the same, except that the heel grinding bars 44 and 54 will be used to engage the work table 60.

After the flat graver 114 is properly placed and adjusted in the apparatus the work-table engaging legs, 22–24, if the heel facet H is to be ground first, will be placed on the work table 60 and the cutting end of the graver on the proper stone in the stone assembly 55, and the heel is ground to provide a pitch angle, as *b*, which may be, say 15°.

For the grinding of the face, F, the legs, 30–31, are placed on the work table 60 and the cutting end of the graver on the proper stone in the stone assembly 55, and the graver ground to have a face angle *a* of, say 45°. Most engravers prefer a face angle of 45°. That is also the face angle provided by the manufactureres, as shown in FIG. 9, where the heel pitch angle is zero.

When a particular job requires a heel pitch angle greater than *b* as, for example *c*, which may be say 30°, and the value of the face angle is to remain the same, then it is important that this may be accomplished by raising the effective height of the work table 60 by placing a glass plate 67 of a properly selected thickness between the legs, 22–24, and the work table 60 and grinding the heel. Then, when the face is to be ground, this same glass plate 67 is placed under the stone assembly 55 and legs, 30–31, are placed on the work table 60, and the face is ground until the desired face angle of 45° is obtained.

Note, with this apparatus four distinct and important grinding operations may be performed on a graver requising only one proper initial positioning and adjustment of the graver in the apparatus.

It is, of course, readily understood that for grinding the face of either a square graver or a flat graver legs 22 and 24 will engage the work table. When the heel of a flat graver is ground legs 30 and 31 engage the work table.

Since the square graver has two heels edge 44 will engage the work table for the grinding of one heel and edge 54 will engage the work table for the grinding of the other heel.

Neither the material herein mentioned as having been used, nor the steps of assembly herein mentioned for some of the elements are part of this invention.

For example, block 19 and the legs 22 and 24, or block 27 and the guide rails 33 and 35, or frame 1 and bearing hub 3, may comprise three ornamental castings of either aluminum or any of its light weight strong alloys, or any other easily cast material.

Having fully described and shown the novel features of this invention, to be protected by United States Letters Patent, I claims:

1. In apparatus for sharpening a hand operated cutting tool, as for example a graver, comprising, in combination, an elongated frame having, as a rigid part thereof, a bearing hub disposed so that its axis is normal to the mid-line of the elongated frame, a cutting tool carrying shaft rotatably disposed in the bearing hub, said shaft having a longitudinal opening shaped to receive on a seat the shank of a cutting tool, means for locking the shank of the cutting tool against the seat, means for locking the shaft in any angular position in the bearing hub, a block mounted on one end of the frame, said frame and block being designed for adjustment of the block longitudinally of the frame, means for locking the block in any position of adjustment, said block having, with respect to the hub axis, two circumferentially spaced work table engaging regions disposed at equal radial distances from the hub axis, a second block mounted on the other end of the frame, said frame and second block being designed for longitudinal adjustment of the second block on the other end of the frame, means for locking the second block in any position of adjustment on said other end of the frame, said second block having, with respect to the hub axis, two circumferentially spaced work table engaging regions which are disposed at equal radial distances from the hub axis.

2. The device of claim 1 wherein said second block also has, with respect to the hub axis, two circumferentially spaced work table engaging regions, which are disposed at unequal radial distances from the hub axis.

3. In apparatus for sharpening a hand operated cutting tool, as for example a graver, comprising, in combination, an elongated frame having, as a rigid part thereof, a bearing hub disposed so that its sxis is normal to the mid-line of the elongated frame, a cutting tool carrying shaft rotatably disposed in the bearing hub, said shaft having a longitudinal opening shaped to receive on a seat the shank of a cutting tool, means for locking the shank of the cutting tool against the seat, means for locking the shaft in any angular position in the bearing hub, a block mounted on one end of the frame, said frame and block being designed for adjustment of the block longitudinally of the frame, means for locking the block in any position of adjustment, said block having, with respect to the hub axis, two circumferentially spaced work table engaging regions, with corresponding points on said regions being disposed at equal radial distances from the hub axis, a second block mounted on the other end of the frame, said frame and second block being designed for longitudinal adjustment of the second block on the other end of the frame, means for locking the second block in any position of adjustment on said other end of the frame, an arcuate sector, a pivot point for pivotally securing the arcuate sector at its center to said second block, means for clamping the arcuate sector into any of the angular positions of adjustment on the second block, a work table engaging region on the arcuate sector disposed more remote from the hub axis than the pivot point of the arcuate sector, whereby, by means of changes of the longitudinal position of the second block on the second end of the frame and of changes of the angular position of the arcuate sector on the second block, the work table engaging regions may be circumferentially changed with respect to the hub axis and changed to various radial distances from the hub axis.

4. The device of claim 3 wherein the pivot point of the arcuate sector is to one side of the longitudinal midline of the frame, a second arcuate sector, a pivot point for the second arcuate sector disposed at the other side of the longitudinal midline of the frame, for pivotally securing the second arcuate sector at its center to said second block, means for clamping the second arcuate sector into any of the angular positions of adjustment on the second block, a work table engaging region on the second arcuate sector disposed more remote from the hub axis than the pivot point of the second arcuate sector, whereby, by means of changes of the longitudinal position of the second block on the second end of the frame and of changes of the angular positions of both arcuate sectors on the second block, all the work table engaging regions associated with the second block may be circumferentially changed with respect to the hub axis and changed to various radial distances from the hub axis.

5. A method of sharpening a graver upon a grinding stone assembly to change the heel angle and maintain the face angle constant, with said graver mounted in a frame, said method, comprising, placing a flat spacing block of a selected thickness between the work table and the work-table engaging regions associated with one end of the frame, grinding the heel, then placing the same flat spacing block under the grinding stone assembly and then grinding the face of the cutting tool with the work-table engaging regions associated with the other end of the frame, on the work table.

* * * * *